US011440033B2

(12) United States Patent
Schoeck

(10) Patent No.: US 11,440,033 B2
(45) Date of Patent: Sep. 13, 2022

(54) MIXER, MULTI-COMPONENT DISPENSER, AND METHOD OF DISPENSING MULTI-COMPONENT MATERIAL FROM A MULTI-COMPONENT DISPENSER

(71) Applicant: Sulzer Mixpac AG, Haag (CH)

(72) Inventor: Joachim Schoeck, Winterthur (CH)

(73) Assignee: MEDMIX SWITZERLAND AG, Haag (CH)

( * ) Notice: Subject to any disclaimer, the term of this patent is extended or adjusted under 35 U.S.C. 154(b) by 151 days.

(21) Appl. No.: 16/957,178

(22) PCT Filed: Dec. 13, 2018

(86) PCT No.: PCT/EP2018/084696

§ 371 (c)(1),
(2) Date: Jun. 23, 2020

(87) PCT Pub. No.: WO2019/129498

PCT Pub. Date: Jul. 4, 2019

(65) Prior Publication Data

US 2020/0391234 A1 Dec. 17, 2020

(30) Foreign Application Priority Data

Dec. 29, 2017 (EP) ..... 17211041

(51) Int. Cl.
*B05B 7/04* (2006.01)
*B01F 25/432* (2022.01)
*B01F 33/501* (2022.01)

(52) U.S. Cl.
CPC ..... *B05B 7/0408* (2013.01); *B01F 25/432* (2022.01); *B01F 33/50112* (2022.01)

(58) Field of Classification Search
CPC ..... B05B 7/0408; B01F 25/432; B01F 33/50112; B01F 2101/2305; B01F 25/4321; B01F 25/12; A61M 5/19; B05C 17/00566; B05C 17/00516
See application file for complete search history.

(56) References Cited

U.S. PATENT DOCUMENTS 3,795,259 A 3/1974 Brandin et al.
4,753,536 A * 6/1988 Spehar ..... B05C 17/00506 222/137
6,601,987 B2 8/2003 Finder et al.
(Continued)

FOREIGN PATENT DOCUMENTS

DE 4235736 C1 * 3/1994 ..... B29B 7/7442
DE 29912888 U1 * 9/1999 ..... B05C 17/00509
(Continued)

OTHER PUBLICATIONS

International Search Report dated Mar. 21, 2019 in corresponding International Patent Application No. PCT/EP2018/084696, filed Dec. 13, 2018.

*Primary Examiner* — Paul R Durand
*Assistant Examiner* — Bob Zadeh
(74) *Attorney, Agent, or Firm* — Global IP Counselors, LLP

(57) ABSTRACT

A mixer for mixing multi-component materials includes a mixing element and an inlet. The mixing element is arranged at a longitudinal axis of the mixer for mixing multi-component materials. The inlet section is arranged at the longitudinal axis.

19 Claims, 4 Drawing Sheets

(56) References Cited

U.S. PATENT DOCUMENTS

| | | | | |
|---|---|---|---|---|
| 8,696,193 | B2 | 4/2014 | Herbstritt | |
| 8,834,016 | B1 | 9/2014 | Richie et al. | |
| 2007/0160890 | A1 | 1/2007 | David et al. | |
| 2007/0026347 | A1 | 2/2007 | Yao | |
| 2010/0062127 | A1 | 3/2010 | Bongers et al. | |
| 2014/0361037 | A1 | 12/2014 | Green | |
| 2016/0030899 | A1 | 2/2016 | Worthy et al. | |
| 2018/0117606 | A1* | 5/2018 | Bertness | B05B 7/0408 |
| 2020/0391234 | A1* | 12/2020 | Schoeck | B01F 13/0023 |

FOREIGN PATENT DOCUMENTS

| | | | | |
|---|---|---|---|---|
| DE | 29912888 | U1 | 9/1999 | |
| EP | 1731216 | A1 | 12/2006 | |
| EP | 2403633 | B1 | 4/2013 | |
| WO | 2005/095225 | A1 | 10/2005 | |
| WO | WO-2005095225 | A1 * | 10/2005 | B05C 17/00516 |
| WO | 2017/030576 | A1 | 2/2017 | |

* cited by examiner

MIXER, MULTI-COMPONENT DISPENSER, AND METHOD OF DISPENSING MULTI-COMPONENT MATERIAL FROM A MULTI-COMPONENT DISPENSER

CROSS-REFERENCE TO RELATED APPLICATION

This application is a U.S. National Stage application of International Application No. PCT/EP2018/084696, filed Dec. 13, 2018, which claims priority to European Patent Application No. 17211041.3, filed Dec. 29, 2017, the contents of each of which are hereby incorporated herein by reference.

BACKGROUND

Field of the Invention

The present invention relates to a mixer for mixing multi-component materials, the mixer comprising a mixing element arranged at a longitudinal axis of the mixer for the mixing multi-component materials, and an inlet section arranged at the longitudinal axis. The invention further relates to a multi-component dispenser and to a method of dispensing multi-component material from a multi-component dispenser.

Background Information

Mixers respectively mixing tips, as they are also known as, are used to mix multi-component material dispensed from a multi-component cartridge. Such mixers are used in a plethora of fields of application ranging from industrial applications, such as the use of adhesives to bond structural components one to another, or as protective coatings for buildings or vehicles, to medical and dental applications, for example, to make dental molds.

The multi-component material is, for example, a two-component adhesive comprising a filler material and a hardener. In order to obtain the best possible mixing result, e.g. an adhesive having the desired bond strength, the multi-component material has to be thoroughly mixed.

For this purpose the mixers comprise mixing elements arranged one after the other that repeatedly divide and re-combine part flows of the multi-component material to thoroughly mix the multi-component material.

SUMMARY

On mixing the multi-component material, the material remaining in the mixer after the dispensing process is generally discarded as it remains in the mixer. Depending on the field of application the multi-component material can be comparatively expensive and may only be used for one application at a time. This is particularly true, for example in the dental field, where only part of the multi-component material stored in the cartridge is used for one application/patient at a time with the remaining multi-component material being stored in the multi-component cartridge for future applications. Thus, the excessive use of large volumes of multi-component material remaining in a mixer after a single use leads to unnecessary cost.

Moreover, if the difference in viscosities between the two fluids present in the multi-component cartridge is too large, then the resistance the fluid having the higher viscosity experiences as it traverses through the mixer is greater than that of the low viscosity fluid and hence can cause the low viscosity fluid to traverse through the mixer faster than the high viscosity fluid causing a sub-optimal mixing result.

For this reason it is an object of the present invention to provide a mixer that guides the multi-component material efficiently through the mixer for a thorough mixing of the multi-component material in the mixer, that enables a reduction in the amount of mixing material left behind in a mixer and that can be produced in an as facile manner as possible.

This object is satisfied in accordance with the subject matter having the features described herein.

Such a mixer can comprise a mixing element arranged at a longitudinal axis of the mixer for mixing multi-component materials; and an inlet section arranged at the longitudinal axis; wherein the inlet section comprises a first channel for conducting a first component from an inlet side to an outlet side, wherein said first channel splits up into a set of sub-channels within the inlet section, the set of sub-channels opening into a set of first outlets arranged at the outlet side and the first outlets being configured to direct a flow of the multi-component material to the mixing element arranged at the outlet side of the first outlets.

The use of a set of sub-channels to direct the flow of low viscosity material to the mixing element arranged at the outlet side of the first outlets in several partial streams and hence at spatially different locations ensures that the volume of low viscosity material arriving at the mixing element is reduced in comparison to prior art mixers and that due to the change in cross-section of the first channel that the resistance the low viscosity material experiences is increased in order to slow down the low viscosity material. Reducing the amount of low viscosity material arriving at the mixing element leads to an improvement of the mixing results achieved, since the respective flows of the multi-component material now comprise approximately the correct ratio of high viscosity material to low viscosity material on entering the mixing element in comparison to prior art mixers.

Thus, the inlet section is designed to achieve the best possible mixing results while using as small a volume of the respective material of the multi-component material as possible in order to limit the waste of multi-component material.

Preferably at least some and preferably all of the sub-channels are of cylindrical shape over at least a part of their length, optionally with the set of sub-channels being arranged such that they extend in parallel to the longitudinal axis. Circular channel diameters have shown the best mixing results in contrast to flat channels that are also conceivable but do not work as well. In this connection it should also be noticed that in contrast to circular channel designs, flat channel designs potentially face problems with manufacturing accuracy, hence cylindrically shaped sub-channels can also be manufactured in a more facile manner.

Advantageously a ratio of length of the sub-channels of cylindrical shape to inner diameter is at least 8, preferably at least 10 and especially less than 20. In this connection it should be noted that the length of the channels has found to be relevant as the high viscosity material has to flow in parallel to the low viscosity material guided through the first channel and the low viscosity material has to build up back-pressure in the sub-channels prior to exiting these. By selecting the length of the sub-channels appropriately one can set the ratio of high viscosity material to low viscosity material entering the mixing element, with the ratio set being required for a good mixing result of the materials in question.

It is preferred if the first outlets have an at least substantially circular outer and/or inner shape at the outlet side. As mentioned in the foregoing circular channel diameters have shown the best mixing results and are simpler to manufacture.

Preferably the set of sub-channels comprises between 3 and 12 sub-channels, preferably wherein the set of sub-channels comprises between 5 and 10 sub-channels, in particular wherein the set of sub-channels comprises 6 sub-channels.

Providing between 3 and 12 sub-channels enables a tailoring of the inlet section to the difference in viscosity between the different multi-component materials used. For mixtures having a large difference in viscosities six partial streams are considered as ideal. The number of sub-channels also relates to the space available for the high viscosity fluid flowing from the inlet section at the outlet side thereof, too many sub-channels leave no room for the high viscosity material and too few channels are not optimal for a good mixing result.

Advantageously an area of the first channel perpendicular to the longitudinal axis is greater than a sum of the areas of the set of sub-channels perpendicular to the longitudinal axis. By compressing the size of the flow path made available for the first component, the low viscosity material comes into contact with a larger area of an inner wall of the sub-channel with which it interacts, increasing the resistance on the low viscosity component and hence slowing it down in comparison to prior art mixers.

It is preferred if the first channel splits up into a set of sub-passages prior to splitting up into the set of sub-channels within the inlet section. In this way the cross-section of the flow path of the component flowing through the first channel can be reduced stepwise using two steps.

The set of sub-channels in particular comprises more sub-channels than the set of sub-passages comprises sub-passages, especially wherein twice as many sub-channels are provided as sub-passages. Such an arrangement of sub-channels and sub-passages has shown to yield good mixing results. Moreover, arranging the sub-channels in pairs means they can also be connected one to another using webs to enhance the stability of the sub-channels.

It is advantageous if the set of sub-passages extends between the first channel and the set of sub-passages inclined with respect to the longitudinal axis, in this way a size of the inlet section can be reduced and a flow path of the first component can be directed towards the mixing element.

It is further preferred if the set of sub-passages are arranged in an intermediate section arranged between the inlet side and the outlet side, with a transition between the intermediate section and an outlet end of the inlet section comprising an outlet conversion of the set of sub-passages to the set of sub-channels; and/or with a transition between the intermediate section and an inlet end of the inlet section comprising an inlet conversion of the first channel to the set of sub-passages. Such an arrangement permits the inlet section to be formed from two or more parts that are subsequently connected one to another, thereby facilitating the manufacturing thereof.

Advantageously the inlet section comprises an outlet region and the set of sub-channels are distributed over the outlet region, preferably wherein the set of sub-channels are unevenly distributed over the outlet region. In this way the component flowing from the first outlets is split up over the outlet region to ensure a mixing with a further component.

Preferably the set of sub-channels having the first outlets project from the outlet region, in particular wherein the set of sub-channels having the first outlets project from a base section arranged at a base of the outlet region, preferably wherein the set of sub-passages split up into said set of sub-channels within the base section. Forming the first outlets such that they project beyond the outlet region means that a length of the sub-channels can be designed such that a back-pressure can be built up in the comparatively narrow sub-channels to ensure that the first and second components arrive at the mixing element at approximately the same time and at approximately the same speed to enable a good mixing result.

Advantageously the mixing element has a mixing element area perpendicular to the longitudinal axis that is less than an area of the outlet region perpendicular to the longitudinal axis, wherein the first outlets are arranged projecting from the base section and distributed over an area corresponding to the mixing element area of the mixing element. In this way the flow of the first component can be directed directly at the mixing element.

It is preferred if the inlet section comprises a second channel for conducting a second component from the inlet side to the outlet side, wherein the second channel has a second outlet, in particular only one second outlet, at the outlet region. In this way the low viscosity material is split up into several partial streams that are fed into the high viscosity material at spatially different locations to improve a mixing result.

In this connection it is advantageous if the second outlet surrounds the first outlets, and preferably surrounds each of the first outlets in order to ensure an injection of the low viscosity material into the high viscosity material at spatially different locations.

Preferably the first outlets project from the outlet region beyond a height of the second outlet. In this way the second component that needs to establish flow can flow towards the first outlets while the first component builds up sufficient back-pressure in the sub-channels, so that the two components arrive at the mixing element at substantially the same time and the same speed to ensure a thorough through mixing thereof.

It is preferred if an area of the second channel perpendicular to the longitudinal axis at the inlet side is less than an area of the second outlet perpendicular to the longitudinal axis. Increasing the area available for the second component, i.e. the component that has a higher viscosity than the component flowing through the sub-channels, means that the second component is less likely to come into contact with the inner housing wall in the region of the outlet region. The contact between the second contact and the inner housing wall produces a resistance between the two causing the second component to slow down.

It is further preferred if the first and second channels comprise first and second inlets for connecting the mixer to a cartridge comprising first and second containers for storage of the multi-component materials. In this way the inlets into the mixer can also function as a connector to the cartridge.

Advantageously a spacing between the first outlets and a first mixing segment of the mixing element is selected in the range of 0.1 to 1, preferably 0.4 to 0.6, especially around 0.5, times the height of the first mixing segment along the longitudinal axis. By setting the spacing between the first mixing segment of the mixing element and the first outlets, the mixer can be tailored to the specific viscosities of the multi-component materials to be mixed in the mixer.

A further aspect the present invention relates to a multi-component dispenser, the multi-component dispenser comprising: a mixer in accordance with the teaching presented herein; a cartridge, with the cartridge preferably being filed with multi-component material; as well as a dispensing mechanism configured to bring about a movement of the multi-component material from the cartridge and through the mixer.

The advantages discussed in the foregoing in relation to the mixer likewise hold true for the dispensing assembly in accordance with the invention.

The multi-component cartridge of the multi-component dispenser can thus be filled with materials selected from the group of members consisting of topical medications, medical fluids, wound care fluids, cosmetic and/or skin care preparations, dental fluids, veterinary fluids, adhesive fluids, disinfectant fluids, protective fluids, paints and combinations of the foregoing.

Such fluids and hence the dispensing assembly can therefore be expediently used in the treatment of target areas such as the nose (e.g. anti-histaminic creams etc.), ears, teeth (e.g. molds for implants or buccal applications (e.g. aphtas, gum treatment, mouth sores etc.), eyes (e.g. the precise deposition of drugs on eyelids (e.g. chalazion, infection, anti-inflammatory, antibiotics etc.), lips (e.g. herpes), mouth, skin (e.g. anti-fungal, dark spot, acne, warts, psoriasis, skin cancer treatment, tattoo removal drugs, wound healing, scar treatment, stain removal, anti-itch applications etc.), other dermatological applications (e.g. skin nails (for example anti-fungal applications, or strengthening formulas etc.) or cytological applications.

Alternatively the fluids and hence the dispensing assembly can also be used in an industrial sector, e.g. in the building industry, the automotive industry etc., for example, as adhesives, paints, and/or as protective coatings.

A further aspect the present invention further relates to a method of dispensing multi-component material from a multi-component dispenser in accordance with the present teaching, when filed with multi-component material, the method comprising the steps of: moving the multi-component material from the cartridge into the mixer, with a first component being guided in the first channel; conducting the first component through the first channel and splitting up a flow of the first component in such a way that a set of separated partial-streams of the first component result that subsequently exit the set of first outlets in the direction of the mixing element, and optionally conducting the second component through the second channel to the second outlet such that a stream of material of the second component surrounds each partial-stream of the set of partial-streams of the first component.

By way of such a method the multi-component material can be made available in an expedient manner at the mixing element prior to the actual mixing taking place in the mixer.

BRIEF DESCRIPTION OF THE DRAWINGS

The invention will be explained in more detail hereinafter with reference to the drawings.

DETAILED DESCRIPTION OF THE EMBODIMENTS

Figure 1A:
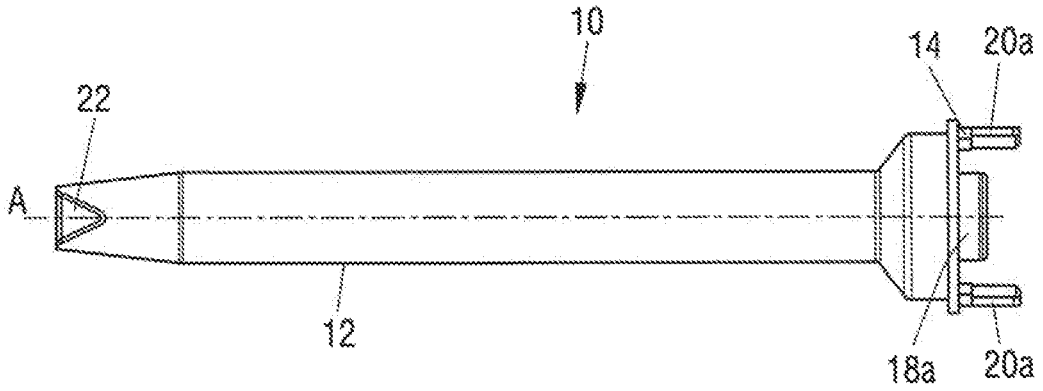
FIGS. 1A and 1B are perspective views of a mixer.

In the following the same reference numerals will be used for parts having the same or equivalent function. Any statements made having regard to the direction of a component are made relative to the position shown in the drawing and can naturally vary in the actual position of application.

FIG. 1A shows a side view of a first type of mixer 10 having a first type of mixer housing 12. The mixer 10 has a longitudinal axis A extending from an inlet section 14 through the housing 12 to an outlet 22 from the housing 12. A mixing element 16 (see FIG. 3A) and part of the inlet section 14 (see FIG. 3A) are arranged within the mixer housing 12. One inlet 18*a* into the inlet section 14 can be seen, as an aligner or alignment device (or means) 20*a*, 20*b* by which the inlet section 14 is aligned relative to a cartridge 100 (see FIG. 2).

Figure 1B:
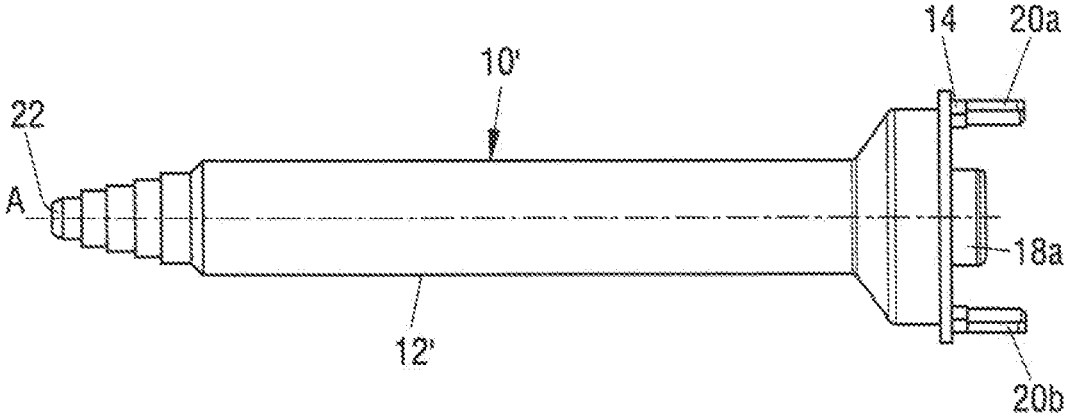

FIG. 1B shows a second type of mixer 10' in a second type of mixer housing 12'. The mixer of FIG. 1B can for example be used for low ratio mixing of components such as 1:1 or 2:1 mixing ratios.

Figure 2:
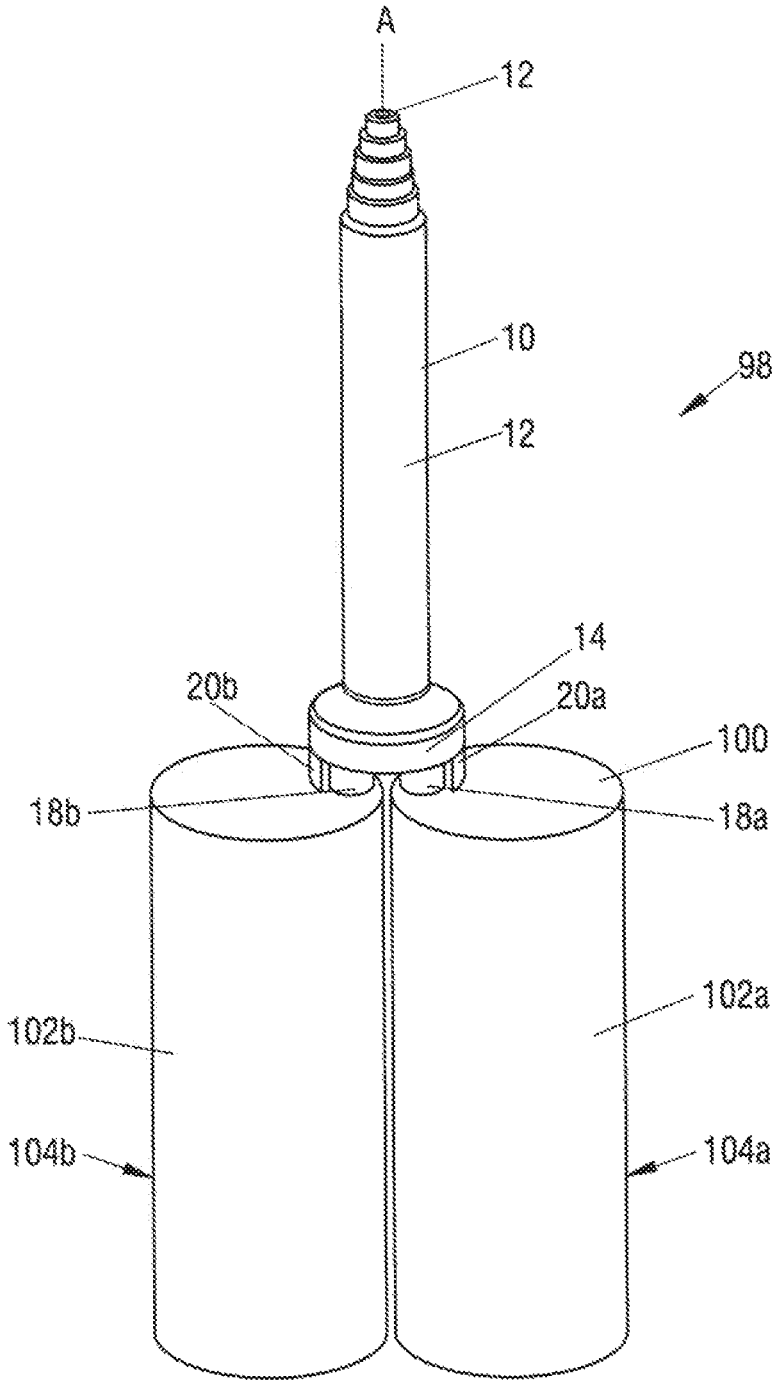
FIG. 2 is a perspective view of dispenser.

FIG. 2 shows a multi-component dispenser 98 comprising a multi-component cartridge 100 and the mixer 10. The multi-component cartridge 100 is filled with respective multi-component materials 102*a*, 102*b*. The multi-component materials 102*a*, 102*b* are stored in respective containers 104*a*, 104*b* and can be discharged from the cartridge 100 by a plunger (not shown) as a dispensing mechanism configured to bring about a movement of said multi-component material 102*a*, 102*b* from the cartridge 100 and into the inlets 18*a*, 18*b* of the inlet section 14 of the mixer 10.

The mixer 10 is connected to the cartridge 100, on the one hand, by the alignment device 20*a*, 20*b* for a coded alignment between the mixer 10 and the cartridge 100. On the other hand, the mixer 10 is connected to the cartridge 100 by a retainer nut (not shown). The retainer nut is adapted to cooperate with the cartridge 100 and engages the mixer housing 12 of the mixer 10 in order to fix the mixer 10 to the cartridge 100.

The mixer 10 could also be connected to the cartridge 100 by other forms of connection means or connectors, such as a bayonet connection or a plug-on connection. Similarly further alignment devices 20*a*, 20*b*, or alignment devices 20*a*, 20*b* different from the ones shown in the drawings can be used to connect the mixer 10 to the cartridge 100 in an aligned manner.

In this connection it should be noted that the following description of the mixer 10 relates to a static mixer 10, it is however possible to employ the inlet section 14 described in the following in a dynamic mixer (not shown).

Figure 3A:
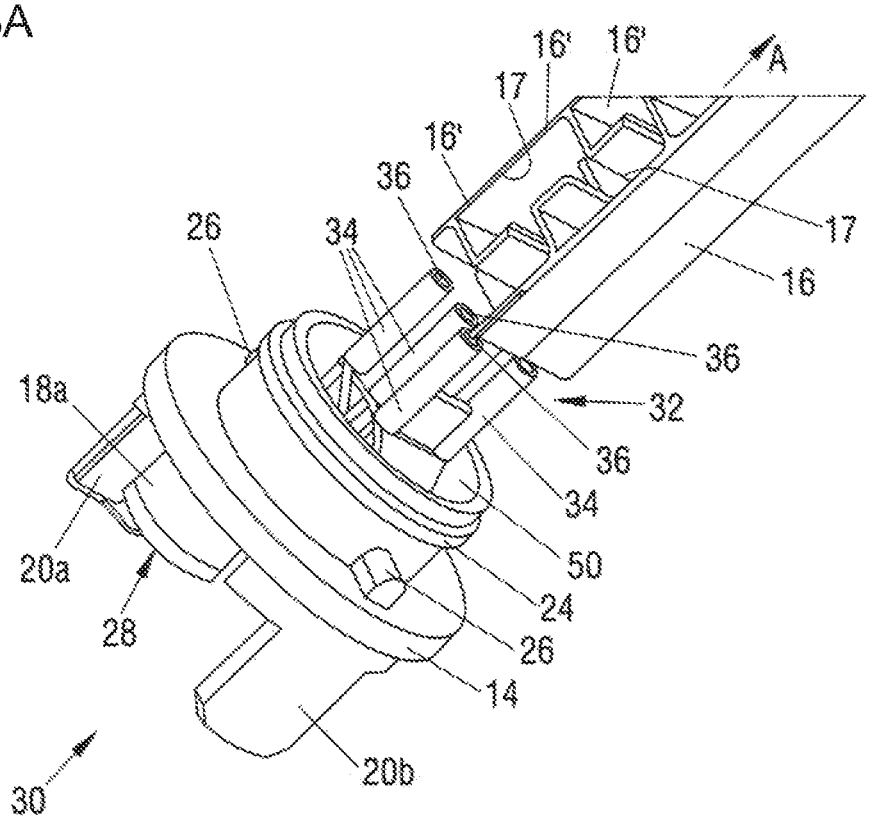
FIG. 3A is a part schematic view of the mixer of FIG. 1A.

FIG. 3A shows a part schematic view of the mixer 10 of FIG. 1A without the housing 12. The housing 12 is typically attached to the inlet section 14 via an annular protrusion 24 that engages a recess (not shown) formed in the inner surface of the housing 12 and two noses 26 that engage corresponding cut outs (also not shown) present at the housing 12.

The mixer 10 is configured to mix multi-component materials 102*a*, 102*b*. For this purpose, the mixer 10 comprises the mixing element 16 arranged at the longitudinal axis A of the mixer 10 and the inlet section 14 also arranged at the longitudinal axis A. The mixing element 16 is configured to mix multi-component materials.

For the purpose of mixing the multi-component material 102*a*, 102*b*, the mixing element 16 comprises several mixing segments 16' arranged one after the other along the longitudinal axis A. Each mixing segment 16' is configured to divide and re-combine part flows of the multi-component material 102*a*, 102*b* along the longitudinal axis A. In this way the part flows of the multi-component material 102*a*, 102*b* are repeatedly divided and re-combined by the mixing element 16 and the several mixing segments 16' along the longitudinal axis A so that the multi-component material 102*a*, 102*b* is thoroughly mixed prior to this exiting the outlet 22.

In this connection it should be noted that each mixing segment 16' of the mixing element 16 can have a height in the direction in parallel to the longitudinal axis A selected in the range of 2 to 18 mm, preferably in the range of 4 to 15 mm.

In this connection it should further be noted that a mixing element 16 is typically composed of between 2 and 20, especially of between 4 and 16 mixing segments 16'. The number of mixing segments 16' used for a mixing element 16 depends on the multi-component material 102*a*, 102*b*, i.e. the viscosities thereof, to be mixed by the mixing element 16.

The inlet section 14 is configured to guide the multi-component materials 102*a*, 102*b* to the mixing element 16 in such a way that a mixing result of the multi-component materials 102*a*, 102*b* is improved in the mixer 10.

The specific type of mixing element 16 used can be varied and can be selected as e.g. a quadro mixer, or a T-mixer sold by Sulzer Mixpac Ltd. The present invention is not limited to the specific type of mixing element 16.

The inlet section 14 comprises a first channel 28 (see also FIG. 3A) for conducting a first component 102*a* of the multi-component material from an inlet side 30 to an outlet side 32.

The first channel 28 splits up into a set of sub-channels 34 within the inlet section 14, with the set of sub-channels 34 opening into a set of first outlets 36 arranged at the outlet side 32. The first outlets 36 are configured to direct a flow of the multi-component material 102*a* to the mixing element 16 arranged at the outlet side 32.

Figure 3B:
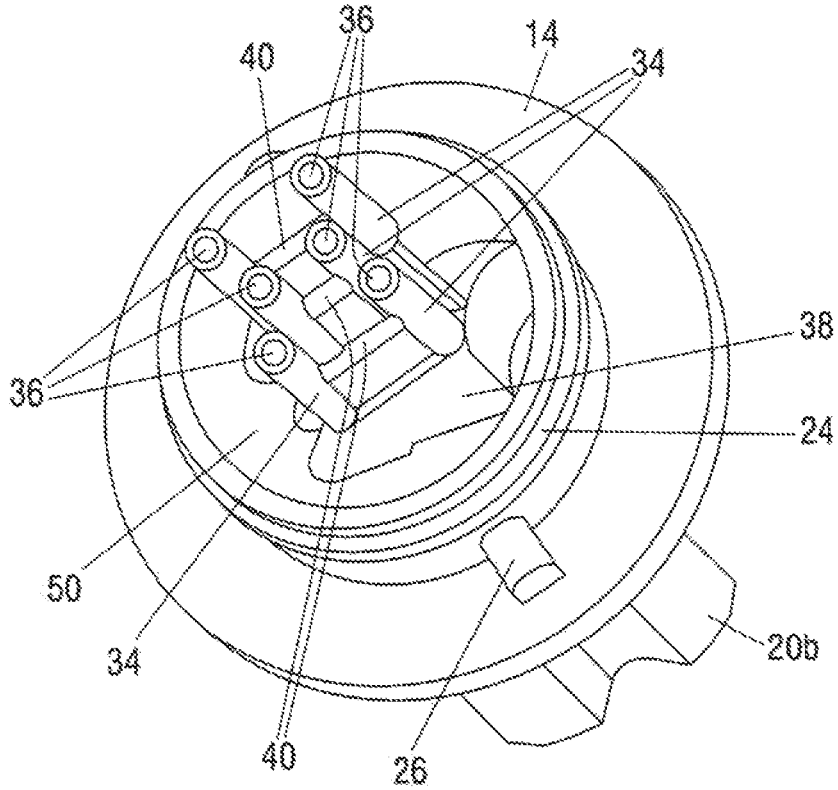
FIG. 3B is an enlarged view of an inlet section of the mixer of FIG. 3A.
Figure 3C:
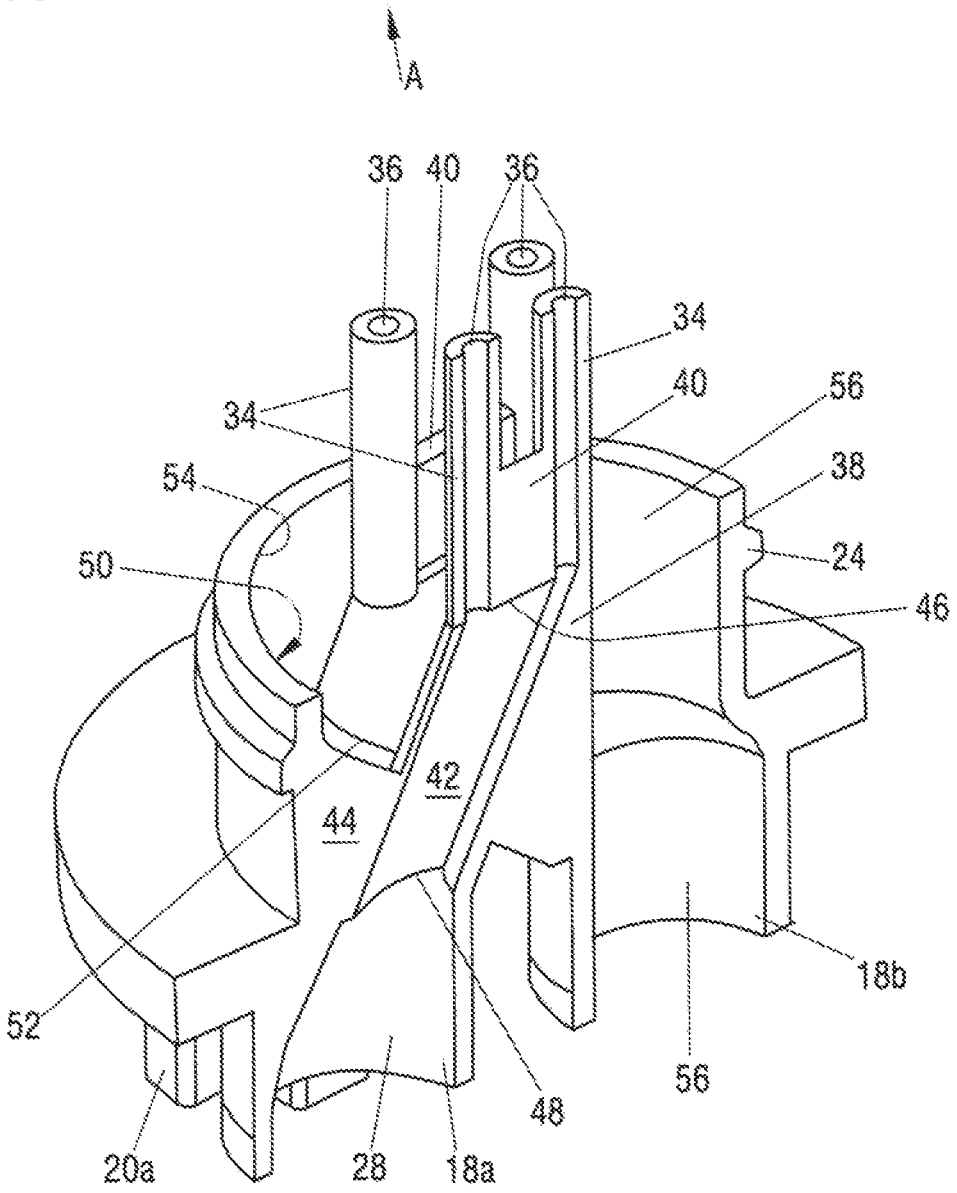
FIG. 3C is a part schematic part sectional view of the inlet section of the mixer of FIG. 3A.

In this connection it should be noted that the inlet side 30 does not denote a specific surface, but rather relates to that part of the inlet section 14 comprising the inlets 18*a*, 18*b*, similarly the outlet side 32 does not denote a specific surface, but rather relates to that part of the inlet section 14 comprising the inlets 18*a*, 18*b* the first outlets 36 and a second outlet 54 (see FIG. 3C).

The mixing element 16 has a mixing element area perpendicular to the longitudinal axis A that is less than an area of an outlet region 50 perpendicular to the longitudinal axis A. The first outlets 36 are arranged distributed over an area corresponding to the mixing element area of the mixing element 16 in order to ensure that a flow of streams of the first component 102*a*, i.e. the low viscosity material, is directed, preferably directly, at the mixing element 16.

In this connection it should be noted that spacing between the first outlets 36 and the mixing element 16, i.e. a first mixing segment 16' of the several mixing segments 16' of the mixing element 16, along the longitudinal axis A is selected in the range of 0.1 to 1, preferably 0.4 to 0.6, especially around 0.5, times the height of the first mixing segment 16' along the longitudinal axis A. In this connection it should further be noted that the spacing between the first outlets 36 and the first mixing segment 16' is selected in the range of range of 0 to 18 mm, in particular in the range of 0 to 15 mm, preferably in the range of 0.2 to 10 mm, especially preferably in the range of 0.4 to 5 mm, particularly in the range of 0.5 to 4 mm, especially of 1 to 3 mm.

In this way a spacing of the first outlets 36 to the mixing element 16 can be set. The spacing can be set in dependence on the difference in viscosities between the low viscosity component 102*a* and the high viscosity component 102*b*. For a large difference in viscosities the spacing between the first outlets 36 and the mixing element 16 is not allowed to be set too large, as the low viscosity component 102*a* then follows pathways as if the sub-channels 34 are not present. This is because the low viscosity component 102*a* can then flow close to walls 17 of the mixing element 16 which leads to a reduction in the mixing result of the multi-component materials 102*a*, 102*b*.

If the distance is selected as too small or if the first outlets 36 penetrate the mixing segment for a smaller difference in viscosities, then the walls 17 of the mixing element 16 may partly block the first outlets 36. In this connection it should also be noted that if the spacing between the first outlets 36 and the mixing segment is too small then the low viscosity component 102*a* can also flow too close to the walls 17.

FIG. 3B shows an enlarged view of the inlet section 14 of the mixer 10 of FIG. 3A. The sub-channels 34 are of cylindrical shape over their length between a base section 38 and the first outlets 36 and extend in parallel to the longitudinal axis A.

A web 40 of material is arranged between each pair of sub-channels 34. The webs 40 of material are respectively provided to connect two sub-channels 34 one to another in order to increase their stability and ensure their alignment with respect to the mixing element 16. The webs 40 of material project from the base section 38 between the respective pair of sub-channels 34.

In this connection it should be noted that a ratio of length of the sub-channels 34 of cylindrical shape to inner diameter of each sub-channel 34 is 10. The first outlets 36 have a circular outer and inner shape at the outlet side 32.

It should further be noted that the length of each sub-channel 34 can be selected in the range of 5 to 20 mm, preferably in the range of 7 to 13 mm and especially around 10 mm.

It should further be noted that an internal diameter of each of the sub-channels 34 and of each of the first outlets 36 is adapted to the viscosity of the low viscosity material 102*a*. In this connection diameters in the range of 0.1 to 2 mm, in particular of 0.7 to 1.3 mm and especially of around 1 mm have been found to be advantageous.

These parameters are selected in order to ensure a uniform guiding of partial streams of the first component 102*a* of the multi-component material directed at the mixing element 16 arranged at the outlet side 32. In this connection it should be noted that it is also important that the diameter of each sub-channel 34 is made with low tolerances.

The inlet section 14 comprises 6 sub-channels 34 in the present instance. It should be noted in this connection that the set of sub-channels 34 could comprise between 3 and 12 sub-channels 34, preferably between 5 and 10 sub-channels 34.

An area of the first channel 28 perpendicular to the longitudinal axis A is greater than a sum of the areas of the set of sub-channels 34 perpendicular to the longitudinal axis A. In the present instance the sum of the areas of the sub-channels 34 amounts to 18.85 $mm^2$ (1 mm diameter for each sub-channel 34), whereas that of the first channel 28 amounts to 28.3 $mm^2$ (3 mm diameter for the first channel 28).

FIG. 3C shows a part schematic part sectional view of the inlet section 14 of the mixer 10 of FIG. 3A. The first channel 28 splits up into a set of sub-passages 42 (of which only one is visible in the section of FIG. 3C) prior to splitting up into said set of sub-channels 34 within the inlet section 14. In the embodiment shown twice as many sub-channels 34 are provided as sub-passages 42.

The set of sub-passages 42 extend between the first channel 28 and the set of sub-channels 34 inclined with respect to the longitudinal axis A. For this purpose the set of sub-passages 42 are arranged in an intermediate section 44 arranged between the inlet side 30 and the outlet side 32.

A transition between the intermediate section 44 and the outlet side 32 comprises an outlet conversion 46 of the set of sub-passages 42 to the set of sub-channels 34.

A transition between the intermediate section 44 and the inlet side 30 comprises an inlet conversion 48 of the first channel 28 to the set of sub-passages 42.

The inlet section 14 further comprises the outlet region 50 and the set of sub-channels 34 are unevenly distributed over the outlet region 50. The set of sub-channels 34 are arranged to project from the outlet region 50. More specifically the set of sub-channels 34 project from the base section 38 arranged at a base 52 of the outlet region 50. The set of sub-passages 42 split up into said set of sub-channels 34 within the base section 38.

The inlet section 14 further comprises a second channel 56 for conducting a second component 102*b* of the multi-component material from the inlet side 30 to the outlet side 32. The second channel has the second outlet 54 at the outlet region 50. The second outlet 54 is designed such that the material 102*b* flowing through the second channel that has a higher viscosity than the material 102*a* flowing through the first channel 28 arrives at the first outlets 36 at approximately the same time as the low viscosity material 102*a*, such that the low viscosity material that has been split up in several partial streams is fed into the high viscosity material 102*b* at spatially different locations prior to entering the mixing element 16, with the first and second materials 102*a*, 102*b* entering the mixing element 16 at approximately the same time and speed and at a desired mixing ratio. For this purpose the second outlet 54 is designed to surround each of the first outlets 36. To ensure an improved mixing the first outlets 36 project from the outlet region 50 beyond a height of the second outlet 54 so that the first component 102*a* can be injected into the second component in an efficient manner.

An area of the second channel 56 perpendicular to the longitudinal axis A at the inlet side 30 is less than an area of the second outlet 54 perpendicular to the longitudinal axis A.

As indicated in FIG. 3C the first and second channels 28, 56 comprise the first and second inlets 18*a*, 18*b* for connecting the mixer 10 to the cartridge 100 comprising first and second containers 104*a*, 104*b* for the storage of the multi-component materials 102*a*, 102*b*.

In use of the mixer 10 the multi-component material 102*a*, 102*b*, is dispensed via the multi-component dispenser 98. For this purpose the multi-component material 102*a*, 102*b* is guided from the cartridge 100 into the inlets 18*a*, 18*b* of the inlet section 14 of the mixer 10.

The first component 102*a* having a lower viscosity than the second component 102*b* is guided in the first channel 28. The first component 102*a* is then conducted through the first channel 28 and split up into partial-flows in the sub-passages 42 present in the intermediate section 44 following the conductance of the first component 102*a* through the sub-passages 42, the first component 102*a* is again split up into the set of sub-channels 34 in such a way that a set of separated partial-streams result that subsequently exit said set of first outlets 36 in the direction of the mixing element 16 for a thorough through mixing with the second component 102*b*.

The second component 102*b*, i.e. the component having a higher viscosity than the first component 102*a*, is conducted through the second channel 56 to the second outlet 54 such that a single stream of material of the second component surrounds each partial-stream of the set of partial-streams of the first component 102*a* in order to feed the first component 102*a* of low viscosity material into the second component 102*b* of high viscosity material such that a pre-mixing of the multi-component material 102*a*, 102*b* takes place before introducing the multi-component material 102*a*, 102*b* into the mixing element 16. Thereby the mixing results achievable with the mixer 10 can be improved considerably in contrast to prior art mixers.

The invention claimed is:

1. A mixer for mixing multi-component materials, the mixer comprising:

a mixing element arranged at a longitudinal axis of the mixer for mixing the multi-component materials; and an inlet section arranged at the longitudinal axis, the inlet section comprising a first channel configured to conduct a first component from an inlet side to an outlet side, the first channel splitting up into a set of sub-channels within the inlet section, the set of sub-channels opening into a set of first outlets arranged at the outlet side and the first outlets being configured to direct a flow of the first component of the multi-component materials to the mixing element arranged at the outlet side, the first channel splitting up into a set of sub-passages prior to splitting up into the set of sub-channels within the inlet section, with the set of sub-channels comprising more sub-channels than the set of sub-passages comprises sub-passages.

2. The mixer according to claim 1, wherein at least some of the sub-channels are of cylindrical shape over at least a part of a length of the at least some of the sub-channels.

3. The mixer according to claim 2, wherein a ratio of a length of each of the sub-channels of the cylindrical shape to an inner diameter of each of the sub-channels is at least 8.

4. The mixer according to claim 1, wherein the set of first outlets have at least a circular outer or inner shape at the outlet side.

5. The mixer according to claim 1, wherein the set of sub-channels comprises between 3 and 12 sub-channels.

6. The mixer according to claim 1, wherein an area of the first channel perpendicular to the longitudinal axis is greater than a sum of the areas of the set of sub-channels perpendicular to the longitudinal axis.

7. The mixer according to claim 1, wherein the set of sub-passages extends between the first channel and the set of sub-channels inclined with respect to the longitudinal axis, or the set of sub-passages are arranged in an intermediate section arranged between the inlet side and the outlet side, with a transition between the intermediate section and the outlet side of the inlet section comprising an outlet conversion of the set of sub-passages to the set of sub-channels, or with a transition between the intermediate section and the inlet side of the inlet section comprising an inlet conversion of the first channel to the set of sub-passages.

8. The mixer according to claim 7, wherein the inlet section comprises an outlet region and the set of sub-channels are distributed over the outlet region, the set of sub-channels having the first outlets project from a base section arranged at a base of the outlet region, and the set of sub-passages split up into the set of sub-channels within the base section.

9. The mixer according to claim 1, wherein the inlet section comprises an outlet region and the set of sub-channels are distributed over the outlet region.

10. The mixer according to claim 9, wherein the set of sub-channels having the first outlets project from the outlet region.

11. The mixer according to claim 9, wherein the mixing element has a mixing element area perpendicular to the longitudinal axis that is less than an area of the outlet region perpendicular to the longitudinal axis, and the first outlets are arranged projecting from a base section and distributed over an area corresponding to the mixing element area of the mixing element.

12. The mixer according to claim 9, wherein the inlet section comprises a second channel for conducting a second component from the inlet side to the outlet side, the second channel has a second outlet at the outlet region, with the second outlet surrounding the first outlets.

13. The mixer according to claim 12, wherein the first outlets project from the outlet region beyond a height of the second outlet, or an area of the second channel perpendicular to the longitudinal axis at the inlet side is less than an area of the second outlet perpendicular to the longitudinal axis, or the first and second channels comprise first and second inlets configured to connect the mixer to a cartridge comprising first and second containers for storage of the multi-component materials.

14. The mixer according to claim 9, wherein the inlet section comprises a single second channel for conducting a second component from the inlet side to the outlet side, the second channel has a second outlet at the outlet region, with the second outlet surrounding the first outlets.

15. The mixer according to claim 1, wherein a spacing between the first outlets and a first mixing segment of the mixing element is selected in the range of 0.1 to 1 times a height of the first mixing segment along the longitudinal axis.

16. A multi-component dispenser comprising:

the mixer in accordance with claim 1;

a cartridge; and a dispensing mechanism configured to move the multi-component materials from the cartridge and through the mixer.

17. A method of dispensing the multi-component materials from the multi-component dispenser according to claim 16, the method comprising:

moving the multi-component materials from the cartridge into the mixer, with the first component being guided in the first channel;

conducting the first component through the first channel and splitting up a flow of the first component such that a set of separated partial-streams of the first component result that subsequently exit the set of first outlets in a direction of the mixing element.

18. The mixer according to claim 1, wherein at least some of the sub-channels are of cylindrical shape over at least a part of a length of the at least some of the sub-channels and are arranged to extend in parallel to the longitudinal axis.

19. The mixer according to claim 1, wherein the inlet section comprises an outlet region and the set of sub-channels are unevenly distributed over the outlet region.

* * * * *